United States Patent [19]

Fulton

[11] Patent Number: 4,930,937

[45] Date of Patent: Jun. 5, 1990

[54] BOX CULVERT TRAVELER FOR USE WITH CONCRETE FORMING SYSTEMS

[75] Inventor: William R. Fulton, San Antonio, Tex.

[73] Assignee: Symons Corporation, Des Plaines, Ill.

[21] Appl. No.: 224,543

[22] Filed: Jul. 26, 1988

[51] Int. Cl.[5] ..... B28B 7/30; E21D 10/04; E21D 11/10; B60B 33/06

[52] U.S. Cl. ..... 405/149; 405/146; 405/150; 249/11; 249/181; 254/89 R; 16/32

[58] Field of Search ..... 405/146, 282, 283, 288, 405/149; 249/10, 11, 27, 155, 181, 183, 219.1, 219.2; 425/62, 63; 254/2 B, 89 R; 248/188.4; 16/32, 9

[56] References Cited

U.S. PATENT DOCUMENTS

| | | | |
|---|---|---|---|
| 1,520,965 | 12/1924 | Pulis et al. | 249/219.2 |
| 2,369,603 | 2/1945 | Phillips | 254/2 R |
| 3,693,927 | 9/1972 | Jennings | 249/181 X |
| 3,696,177 | 10/1972 | Holland | 249/11 X |
| 4,087,072 | 5/1978 | Olsen | 249/219.1 X |
| 4,364,148 | 12/1982 | McVicker | 16/32 |
| 4,450,666 | 5/1985 | Trumbull et al. | 405/146 X |

*Primary Examiner*—Randolph A. Reese
*Assistant Examiner*—Arlen L. Olsen
*Attorney, Agent, or Firm*—Charles F. Meroni, Jr.

[57] ABSTRACT

A traveling culvert/tunnel forming structure including upright waler assemblies positioned in transversely spaced relation on each side of said forming structure, the waler assemblies being adapted to receive forms on outside surfaces thereof. Horizontally adjusted header assemblies are supported at opposite ends by the spaced upright waler assemblies. Collapsible braces are disposed between the upright waler assemblies enabling the upright waler assemblies to move towards and away from one another. Multi purpose mounting brackets are mounted in rows on the upright waler assemblies which brackets are positioned inwardly from the waler assemblies. Rows of casters are swivelly mounted on the brackets inside of the rows of upright waler assemblies beneath the header assemblies. A pair of rows of leveling jacks are provided for elevating the forming structure and its casters out-of-contact with a ground supporting surface. The leveling jacks each have an upstanding jack shaft. Threads on the shaft are in threaded retaining engagement with one of the brackets. The shafts are located between the upright waler assemblies and the casters. The leveling jacks are at all times carried on the brackets in assembly with the forming structure and are vertically adjustable for positioning the upright waler assemblies in predetermined adjusted above ground relation to one another.

14 Claims, 4 Drawing Sheets

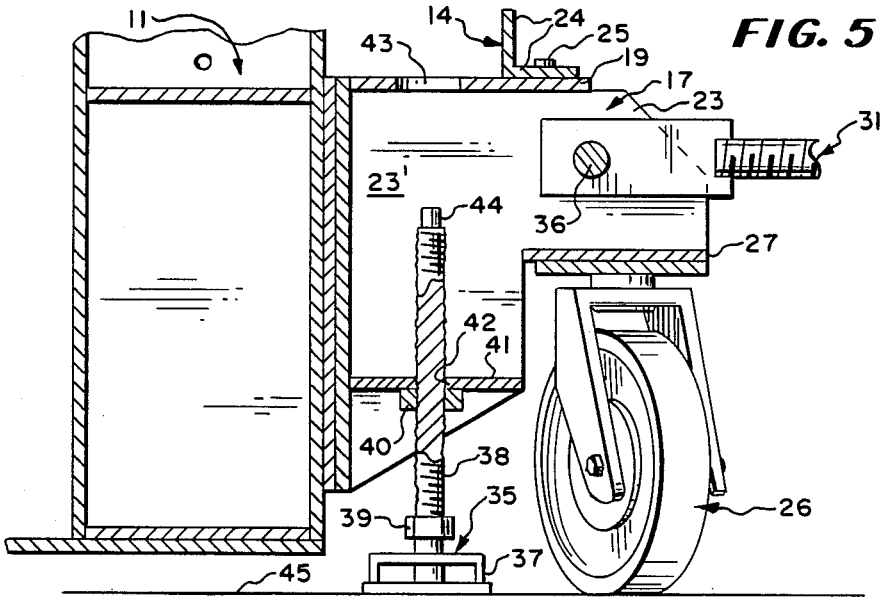
FIG. 5
FIG. 6
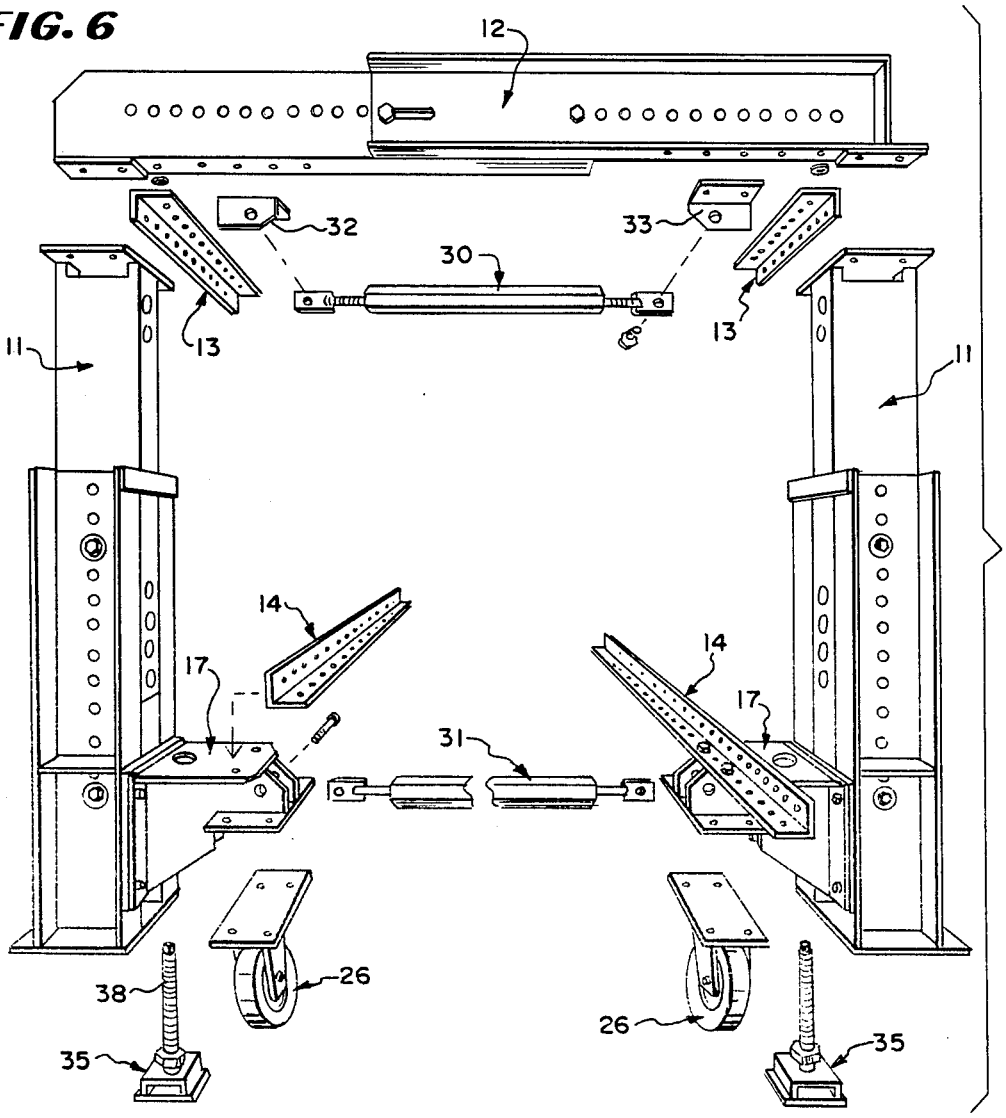

BOX CULVERT TRAVELER FOR USE WITH CONCRETE FORMING SYSTEMS

Field of the Invention

The present invention relates to a traveling culvert-/tunnel forming structure or apparatus. The apparatus is light, fast, and reusable and it can be stripped in one piece and moved on its own wheels from one pour to the next. The simple construction of the apparatus facilitates ready assembly, setting, stripping and moving of the apparatus from one location to the next. Once the apparatus is assembled it becomes a true single unit. No additional accessories are required for setting, stripping or moving.

The apparatus has turn buckle braces for setting and stripping which are a permanent part of the form structure. Extra shoring is usually not required for tunnels or culverts up to eight feet. Wider/thicker tunnels require mid-span shoring which also travels along with the unit. Auxiliary shoring is virtually eliminated The traveling culvert/tunnel forming structure is a frame that will accept different Symon's panel systems and form the inside of box conduits, walls and roof. Each piece has a specific function to (A) Hold panels, (B) Gather concrete pour loads and act as structural members-this includes the jacks, (C) Adjust from one (1) box size to another, (D) Strip forms after concrete has attained a certain strength- this also includes jacks, (E) Roll forms forward to new postion after forms have been stripped, and (F) Hold frames in proper alignment.

The traveler operates by providing a rigid platform for forms to be hung so the box culvert can be poured with concrete. The traveler holds forms in a "square" manner and allows stripping and setting in a simple manner.

In initial set-up, the frames are all assembled to the correct box size, stood up, and then forms are applied to the frames.

The jack-wheel brackets are graded with an air operated impact wrench. Then later a workman uses a hand ratchet wrench for lowering intermediate jacks and finally adjusting all jacks. All jack adjusting is done much more conveniently from an overhead or top position. Previously, the jacks had to be adjusted from the bottom where a large unit was located. This was awkward and difficult, especially where the apparatus or form structure was located in mud and water and/or in the invert of a culvert.

My new and improved traveler including its multi-purpose bracket, allows all of the functions to be accomplished in one place and on one bracket, rather than at multiple locations according to the prior art. These functions are:

(A) Attachment of the jack which is used to vertically plumb the form, carry concrete loads during pouring, and relieve concrete loads prior to stripping the forms. The bracket allows all jacking functions to be accomplished from the top with powered wrench or by hand.

(B) Attachment of a wheel which allows the entire inside of the conduit to be traveled from the area where concrete has been poured to the next location. In most instances, the moving of the forms is done by a crew of men merely pushing the form forward.

(C) Attachment of a stripping ratchet called an adjustable brace. The bracket allows an adjustable brace to be pinned at a level which is very convenient for a worker. The adjustable brace is located high enough to be reached but low enough so that it can be stepped over. This strut, when stripping, applies a force into the bracket and the bracket distributes the force to the vertical frames.

(D) The bracket provides a place for the horizontal aligner angles to be attached by bolts. These braces maintain the proper spacing of the frames at the lower end of the frames. There is another horizontal brace at the top which, together, allows the frames to be assembled standing up before panels are hung on the frames. All other systems, that we are aware of, depend on the panels for proper alignment and rigidity.

The advantage of this bracket are described in A through D and can be summarized by stating that all of the functions of a box conduit form are consolidated conveniently in a multi-purpose bracket.

The built-in jack was built into the bottom panel on a box conduit which means that panel was for a specific use. Also, the prior art jacks have been difficult to operate close to the floor, or invert, of the conduit. My new multi-purpose bracket allows the operator to work from the top and all at one location. In other systems the jacks are in one place, the struts in another and the wheels in yet another location and the panels provide rigidity.

Since my traveler is "free standing" and not dependent on forms for rigidity, and is also a load gathering system, any form system can be used with my traveler from customer provided wood, to Assignee's "Steel-Ply", "Versiform" and "Max-A Form" panel type form systems. These are Symons' systems and the "Max-A Form" version is not complete. When it is complete, the "Max-A-Form" panel will do what the vertical frames do as shown. My multi-purpose bracket will then be used in the same manner, having a vertical jack, struts, and wheels.

Other systems use a loose hand operated jack that has to be lowered and raised and transported by hand. It cannot be operated with an air wrench or socket wrench. With my new bracket construction it provides every function is in one place and is contained in the single bracket, eliminating loose pieces and reducing the labor costs for the customers.

In the past, other types of box culvert travelers have been known as evidenced by U.S. Pat. No. 3,693,927. In this apparatus, the patentee employs manually operated lift jacks 31 which function to lift the roller units 29 out of ground engagement. These jacks cannot be adjusted from an overhead position. It will further be noted that with this apparatus, the jacks 31 and the casters 29 are disposed inalignment with one another and not with the jack being located between the waler or frame units 16 or 17 and the roller units 29. Still further, my unique traveler and its mounting brackets are absent from this prior art.

SUMMARY OF THE INVENTION

In a traveling culvert/tunnel forming structure including upright waler assemblies positioned in rows in transversely spaced relation on each side of said forming structure, the waler assemblies being adapted to receive forms on outside surfaces thereof, horizontally adjustable header assemblies supported at opposite ends by said spaced upright waler assemblies, collapsible braces between the upright waler assemblies enabling the upright waler assemblies to move towards and away from one another, the improvement of multi-purpose mounting brackets mounted on said rows of said upright waler assemblies and extending inwardly from the waler assemblies the mounting brackets being arranged in rows, row of casters swivelly mounted on said brackets inside of said rows of upright waler assemblies beneath said header assemblies, and a pair of rows of leveling jacks for elevating the forming structure and its casters out-of-contact with a ground supporting surface, the leveling jacks each having an upstanding jack shaft, threads on said shaft in threaded retaining engagement with one of said brackets, said shafts being located between said upright waler assemblies and said casters, the leveling jacks being at all times carried on said brackets in assembly with the forming structure and being vertically adjustable for positioning the upright waler assemblies in predetermined adjusted above ground relation to one another.

The forming structure is further characterized by each of the mounting brackets being comprised of a box shaped section for housing one of the leveling jacks, the box shaped section having an opening in the upper surface thereof for receipt of a tool adjusting the position of the leveling jack to lift or drop the associated upright waler assembly, the opening being postioned at an inside location relative to the associated upright waler assembly in immediate adjacency thereto providing ready access for the tool for making the vertical adjustment with said jack shafts, as required.

The forming structure is further characterized by the opening in the upper surface of each box shaped section being arranged in two spaced apart rows with the rows being positioned inside of the spaced upright waler assemblies for ease of making the adjustments.

The forming structure is further characterized by the upright waler assembly being comprised of a series of upright multi sectioned collapsible walers, and corner angles connecting the walers in unitary assembly, the mounting brackets being mounted on as inside lower end of each of said walers.

In a traveling culvert/tunnel forming structure including upright waler assemblies positioned in rows in transversely spaced relation on each side of the forming structure, the waler assemblies being adapted to receive forms on outside surface thereof, horizontally adjustable header assemblies supported at opposite ends by the spaced upright waler assemblies, collapsible braces secured between the upright waler assemblies enabling the upright waler assemblies to move towards and away from one another, the improvement of multi purpose mounting brackets mounted on the rows of the upright waler assemblies and extending inwardly from the waler assemblies the mounting brackets being arranged in rows, rows of casters swivelly mounted on the brackets inside of the rows of upright waler assemblies beneath the header assemblies, and a pair of rows of traveling leveling jacks for elevating the forming structure and its casters out-of-contact with a ground supporting surface, the traveling leveling jacks each having an upstanding jack shaft, threads on the shaft in threaded retaining engagement with one of the brackets in traveling assembly therewith, the shafts being located between the upright waler assemblies and the casters, the leveling jacks being at all times carried on the brackets in assembly with the forming structure, means on the jacks enabling the jacks to be vertically adjustable for positioning the upright waler assemblies in predetermined adjusted above ground relation to one another, the mounting brackets each having a pair of vertically spaced generally parallel plate-like flanges secured therewith and with the flanges having vertically aligned upper and lower openings, each of the jacks being positioned beneath an associated pair of the flanges and with its jack shaft projecting upwardly through the lower opening and having its upper jack shaft and positioned beneath the second opening for receipt of a wrench for adjustment of the jack position by rotation of the jack shaft, a pair of longitudinally extended reinforcing members disposed in transversely spaced relation interiorly of the forming structure with each reinforcing member being mounted on the row of brackets along the associated row of brackets, and means securing the reinforcing menbers to the brackets in the associated rows.

BRIEF DESCRIPTION OF THE DRAWINGS

Further features, objects and advantages of the invention will be found throughout the following more detailed description which refers to the accompanying drawings, disclosing several embodiments, wherein:

FIG. 5 is an enlarged fragmentary verticle section taken on the line 5—5 looking in the direction indicated by the arrows as seen in FIG. 4;

FIG. 6 is an enlarged exploded view of the traveler shown in FIGS. 2 and 3;

DESCRIPTION OF THE PREFERRED EMBODIMENTS

Figure 1:
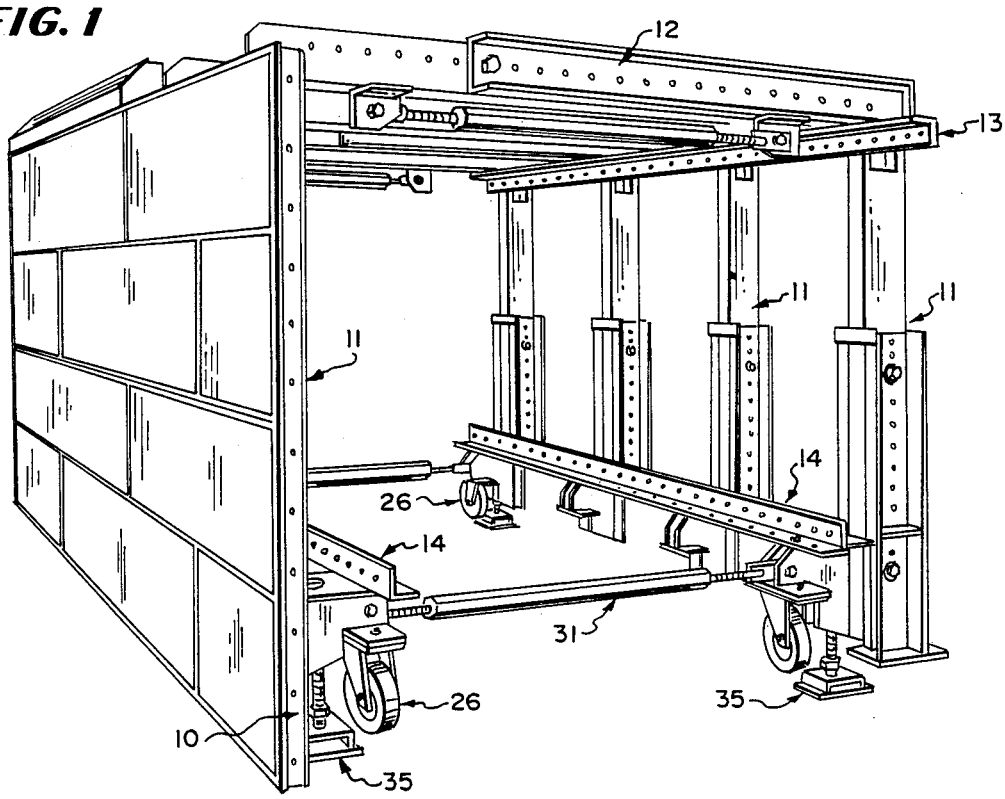
FIG. 1 is a prospective view of my box culvert traveler.

The reference 10 indicates generally my traveling culvert/tunnel structure or traveler. This structure 10 includes upright vertically adjustable waler assemblies 11 that are positioned in transversely spaced upright position along the length of the traveler or forming structure 10. In addition, a series of transversely spaced horizontally adjustably header assemblies 12 are each supported at opposite ends of an associated one of the spaced upright whaler assembleis 11. It will thus be understood that the upright waler assemblies 11 can be ajustably positioned so that the vertical height of the traveler 10 can be varied. In addition, the header assemblies 12 can be horizontally adjusted to vary the spacing between the waler assemblies 11 at opposite sides of the traveler 10. These adjustments can be made in more or less conventional way as is already known in the art prior to my invention.

Figure 2:
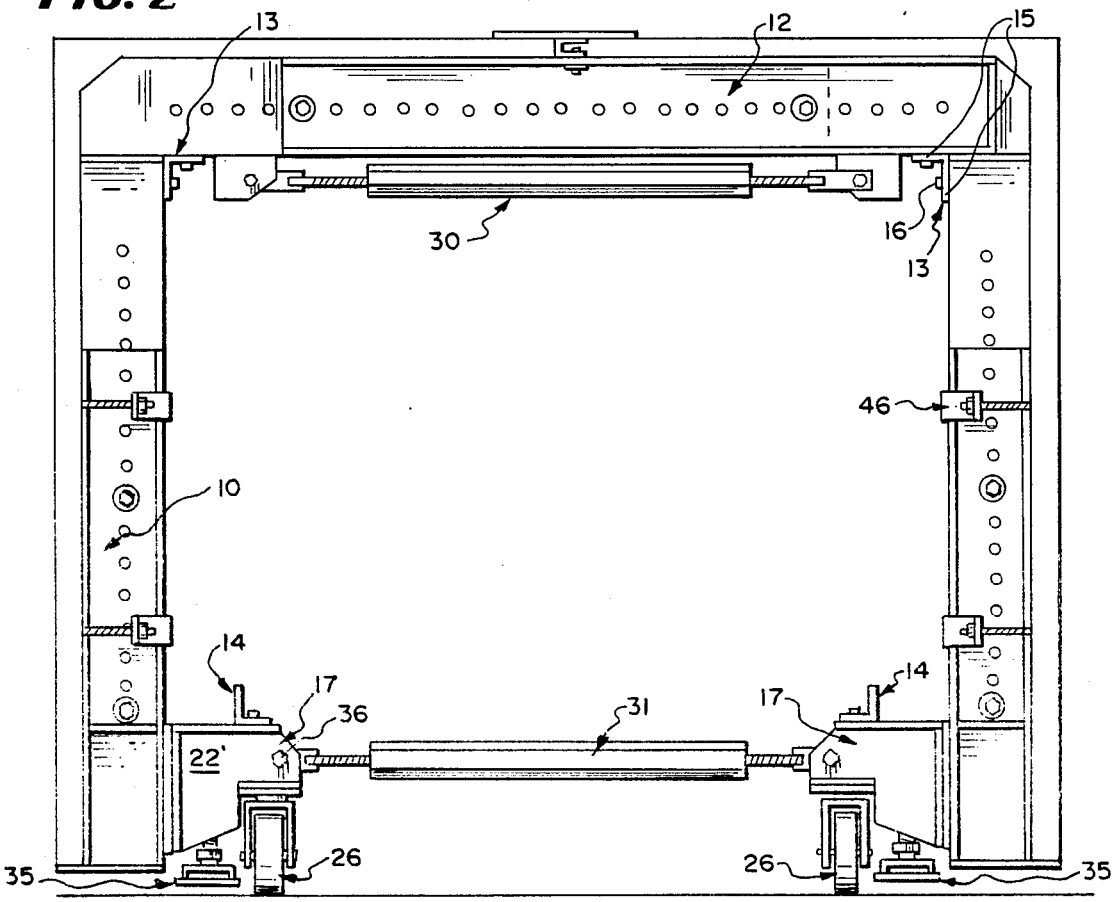
FIG. 2 is an end view of the traveler shown in FIG. 1 only with the jacks being shown in an elevated position.

From a consideration of FIGS. 1 and 2, it will be noted the upright vertically adjustable waler assemblies 11 are connected together by means of upper and lower angles or reinforcing members 13 and 14. These angles are also clearly illustrated in FIG. 6. The angles 13 and 14 each have angle legs 15—15 which are attached by means of fastener 16 to the waler assemblies 11 to the horizontally adjustable header assemblies 12 as shown in FIG. 2.

Figure 4:
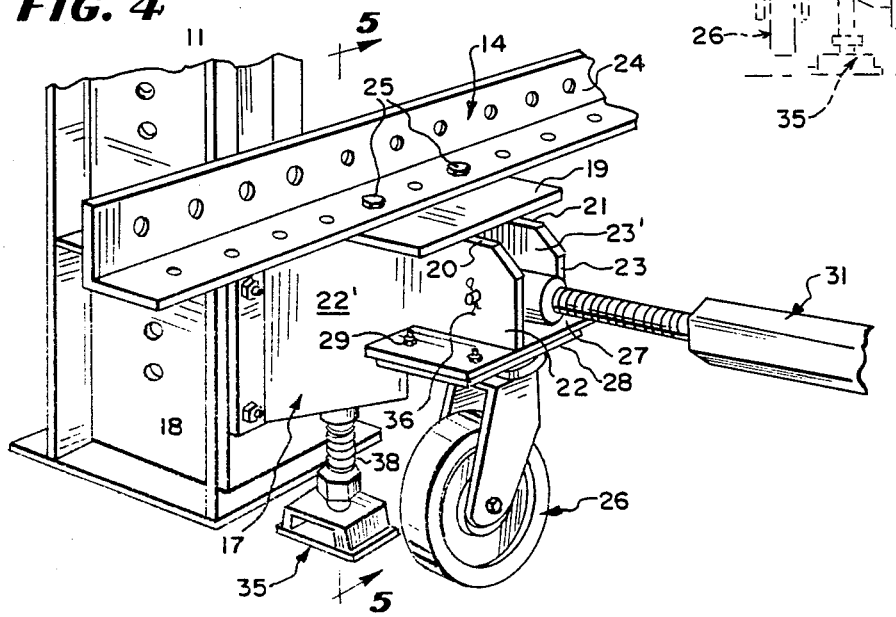
FIG. 4 is an enlarged fragmentary prospective view of a portion of the traveler shown in the preceding figures.

According to important features of my invention, I have provided multi-purpose box shaped mounting brackets 17. These brackets are made from steel plate and are each adapted to be secured to an associated one of the upright vertically adjustable waler assemblies 11 by means of a series of fasteners 18 (FIG. 4). THe various plates comprising the bracket are secured in welded assembly. In addition, the mounting bracket 17 has a horizontal bracket plate 19 that is welded or otherwise suitably secured to a pair of upper edges 20–21 of a pair of parallel upright bracket plates 22'–23'(FIG. 4) which terminate in a pair of parallel upright bracket flanges 22–23. The lower angle 14 has a pair of angle legs 24—24 and fasteners 25 are provided for securing the lower angle 14 in fixed asembly with the bracket flange or bracket mounting plate 19 provided on each of the mounting brackets 17. By using the lower angles of 14 and connecting each of them to the mounting brackets 17 on opposite sides of the traveler 10, the waler assemblies at each side of the traveler are all physically connected and tied together as a unitary assembly. Since the angeles 14 at each side are connected in the same way as just described, and further since the angles 13—13 are also provided to secure upper ends of the waler assemblies 11 to the horizontally adjustable header assemblies 12, the upper angles 13—13 further serve to stabilize and connect the components of the traveler as a unitary structure that can be hoisted by a crane from one location to another and which can also be moved on swivel casters or caster wheel assemblies 26 by a heavy duty tractor or other suitable apparatus.

Welded to underside of upright bracket flanges 22 and 23 is a caster wheel mounting plate 27. The caster wheel assembly 27 has a caster wheel mounting plate 28 and fasteners 29 are used to attach the caster wheel assembly 26 to the plate in unitary assembly therewith (FIG. 4). Thus, the caster wheel assemblies 26 are also secured with the mounting brackets 17 and the caster wheels are positioned in rows spaced from the inside of the waler assemblies 11 at opposite sides of the traveler 10.

Figure 3:
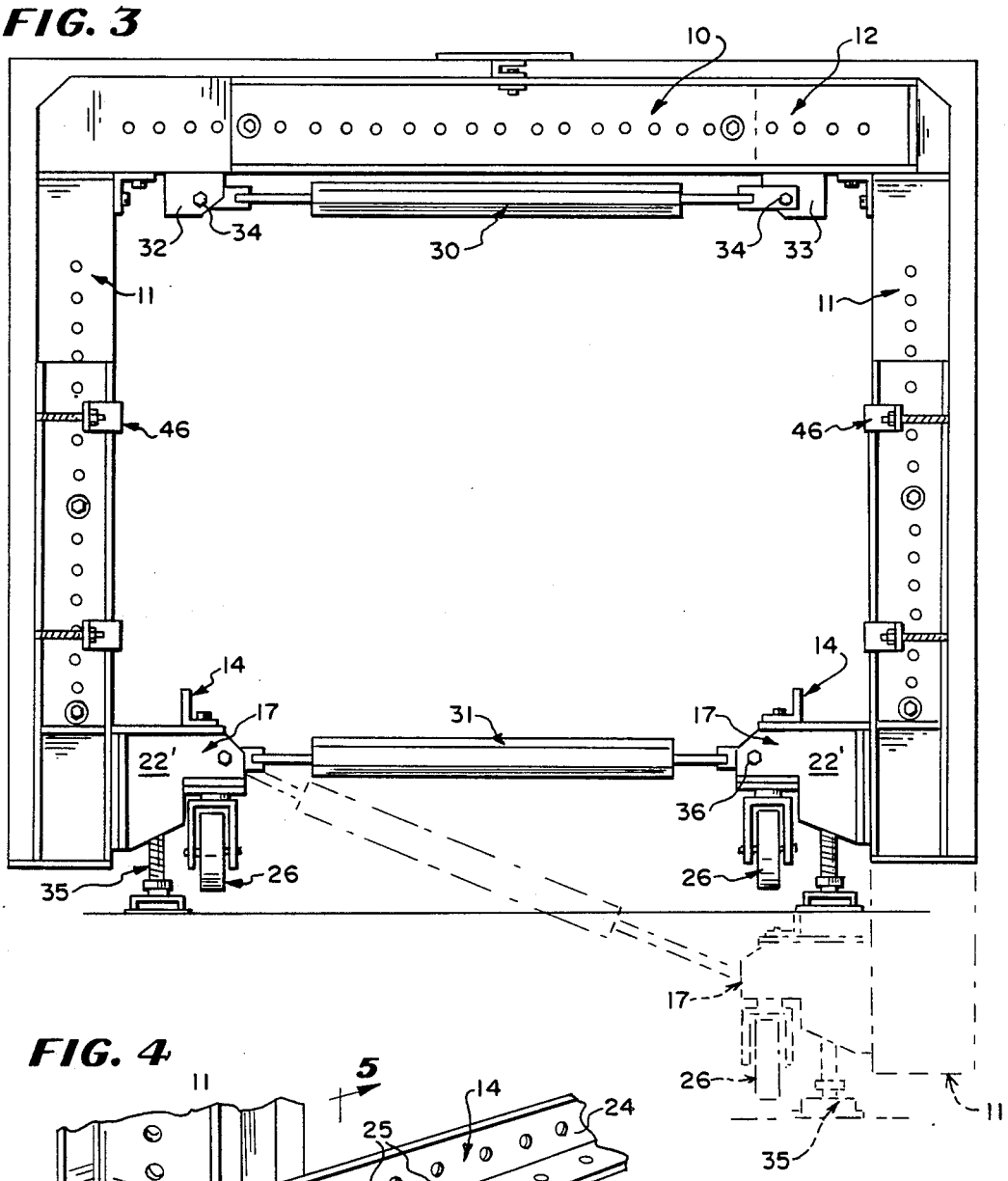
FIG. 3 is an end view similar to FIG. 2 only showing the jacks in ground engaged position, the dotted lines illustrating how the traveler would appear should the traveler be installed on an uneven grade.

In order to rigidify the traveler 10, I have provided a series of upper and lower braces 30 and 31. These braces are of an adjustable type as it is more clearly shown in FIG. 6 and are of a type well known in the art. The upper braces are secured to brace brackets 32 and 33 by suitable fasteners 34. The brackets 32 and 33 are carried upon the underside of the horizontally adjustable header assemblies 12 (FIG. 3).

The lower adjustable brace 31 has its opposite end also secured with the mounting brackets 17 to provide a highly advantageous mounting arrangement therefore consistent with my objective of constructing a multi-purpose mounting bracket which enables an operator to readily set up and asemble the components of my traveler 10 and also to make adjustments upon the mounting bracket and to leveling jacks 35. The ends of the lower braces 31 are secured with each associated mounting bracket at opposite ends of the traveler 10. More specifically, the upright bracket flanges 22 and 23 are spaced so that the associated ends of the lower brace 31 can be telescoped between the flanges 22 and 23 and secured by suitable fasteners 36 in assembly therewith.

According to other important features of my invention, it will be seen that the leveling jacks 35 are of a different type then has been used on travelers 10 in this industry before. In the past, generally bottle-type jacks had been used as shown in U.S. Pat. No. 3,693,927. These bottle jacks are more difficult to use for the reasons already set forth in this heretofore herein. My leveling jack 35 is of the type that includes a stand 37. Each jack has an upstanding threaded jack shift 38. The shaft 38 has an adjustment nut 39 provided thereon. Also, a second adjustment nut 40 is also provided. My box-shaped mounting bracket 17 also is provided with a horizontally extending leveling jack mounting plate or flange 41 which has a central opening 42 and the nut 40 is welded to the flange 41 in centered relation to the opening 42 (FIG.5). This plate or flange is formed as an integral part the mounting bracket 17 and can be either welded or otherwise suitably formed as part of the mounting bracket 17. The jack shaft receiving hole 42 is adapted to receive the threaded jack shift 38 and the nut 40 is properly positioned just beneath the leveling jack mounting plate or flange 41 (FIG. 5). It will further be observed from FIG. 5 that the jack shaft 38 underlies the bracket flange or bracket mounting plate 19. This plate 19 has an opening 43 which is vertically aligned with the jack shaft receiving hole 42 so that a worker can insert a wrench or suitable tool through the opening 43 into contact with a hex-shaped end 44 of the jack shaft 38. By turning the jack shaft 38, the vertically adjustable waler assemblies 11 can be moved into and out of ground contact at 45 (FIG. 5) along with the caster wheel assemblies 26.

Figure 7:
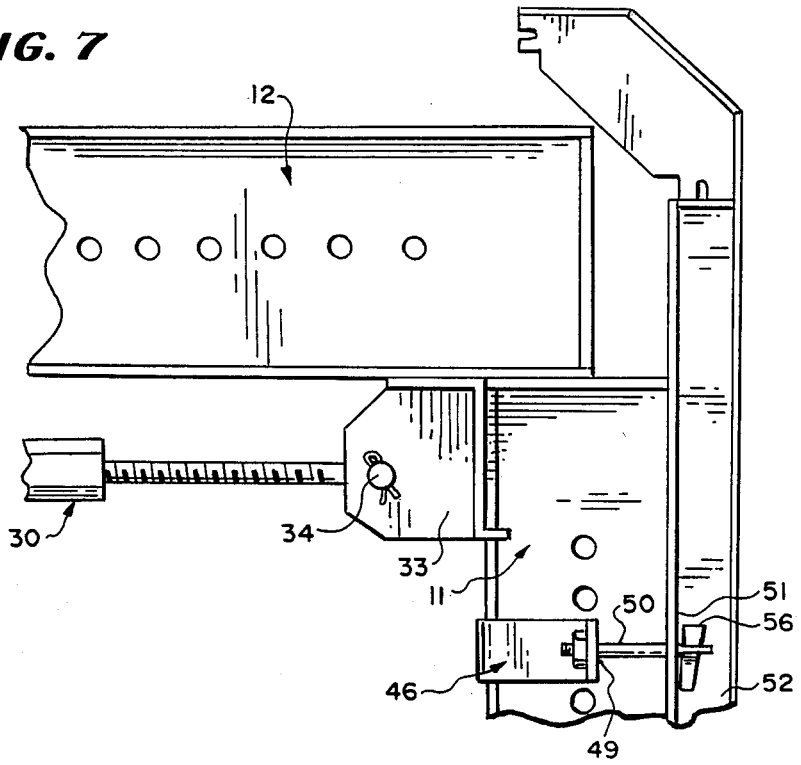
FIG. 7 is an enlarged fragmentary front elevation of an upper portion of the traveler illustrating the way in which panels are connected to the traveler through the use of adjustable straps or clamps.
Figure 8:
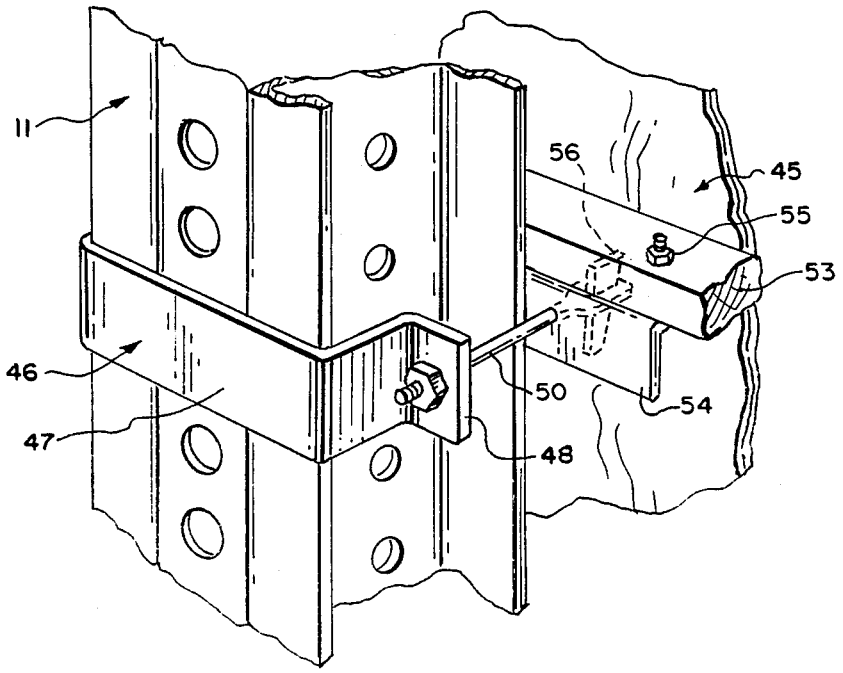
FIG. 8 is an enlarged fragmentary prospective view showing the way in which my traveler can be used with a different type of form.

Mounted upon my traveler 10 are concrete forms 45. In the past, concrete forms have been mounted upon travelers in various ways as is well known in the art. One system for attaching concrete forms is shown in U.S. Pat. No. 3,693,927. According to other features of my invention, I have developed a new and improved technique for securing the concrete forms 45 to the waler assemblies 11 as shown in FIGS. 7 and 8. To this end, I have provided clamp structures identified generally at 46 in FIGS. 7 and 8. Each of these clamp structures includes a U-shaped portion 47 which has outwardly turned terminal flanges 48—48. The U-shaped portion 47 is particularly configurated so that it has a dimension capable of enveloping the outside surface of the waler assembly 11. It will be recalled that various types of concrete forms 45 are adapted to be assembled by my new and improved clamp structure 46 to the walers 11. To this end, and depending upon the type of concrete forms, the outwardly turned terminal flanges have openings 49 for a clamp rod 50. The clamp rod is adapted to extend through spaced waler side flanges 51—51 and secured therewith by suitable means such as wedge-shaped bolts or the like 52.

According to the modified forms shown in FIG. 8, the concrete form 45 is secured to the attachment number 53 is a steel plate type angle 54. This angle 54 is bolted by fasteners 55 to the attachment member 53. The clamp rod 50 extends through holes in the angle 54 on opposite sides of the waler assembly 11. The connecting bolt or rod 50 is secured to the angle 54 by wedge bolts of the type shown at 52 in FIG. 7 in a way that is well-known in this art. The opposite end of the rod 50 is also secured in place by a wedge bolt as in indicated at 56.

As various possible embodiments may be made in the above invention for use for different purpose and as various changes might be made in the embodiments and method above set forth, it is understood that all of the above matters set forth or shown in the accompanying drawings are to be interpreted as illustrative and not in a limiting sense.

I claim:

1. In a traveling culvert/tunnel forming structure including upright waler assemblies positioned in rows in the transversely spaced relation on each side of said forming structure, the waler assemblies being adapted to receive forms on outside surfaces thereof, horizontally adjustable header assemblies supported at opposite ends by said spaced upright waler assemblies, collapsible braces secured between the upright waler assemblies enabling the upright wlaer assemblies to move towards and away from one another, the improvement of multi purpose mounting brackets mounted on said rows of said uprignt waler assemblies and extending inwardly from the waler assemblies to mounting brackets being arranged in rows, rows of casters swivelly mounted on said brackets inside of said rows of upright waler assemblies beneath said header assemblies, and a pair of rows of traveling leveling jacks for elevating the forming structure and its casters out-of-contact with a ground supporting surface, the traveling leveling jacks each having an upstanding jack shaft, threads on said shaft in threaded retaining engagement with one of said brackets in traveling assembly therewith, said shafts being located between said upright waler assemblies and said casters, the leveling jacks being at all times carried on said brackets in assembly with the forming structure, means on said jacks enabling said jacks to be vertically adjustable for positioning the upright waler assemblies in predetermined adjusted above ground relation to one another, said mounting brackets each having a pair of vertically spaced generally parallel flanges secured therewith and with said flanges having vertically aligned upper and lower openings, each of said jacks being positioned beneath an associated pair of said flanges and with its jack shaft projecting upwardly through said lower opening and having its upper jack shaft end positioned beneath said second opening for receipt of a wrench for adjustment of the jack position by rotation of said jack shaft, a pair of longitudinally extended reinforcing members disposed in transversely spaced relation interiorly of said forming structure with each reinforcing member being mounted on an uppermost one of said flanges along the associated row of brackets, and means securing said reinforcing members to said uppermost flange in the associated rows.

2. The forming structure of claim 1 further characterized by each of the mounting brackets being comprised of a box shaped section for housing one of the leveling jacks, the upper opening being positioned at an inside location relative to the associated upright waler assembly in immediate adjacency thereto providing ready access for the tool for making the vertical adjustment with said jack shaft, as required.

3. The forming structure of claim 2 further characterized by the upper opening in each of the box shaped sections being arranged in two spaced apart rows with the rows being positioned inside of the spaced upright waler assemblies for ease of making the adjustments.

4. The forming structure of claim 1 further characterized by the upright waler assembly being comprised of a series of upright multi sectioned collapsible walers, and corner angles connecting the walers in unitary assembly, the mounting brackets being mounted on an inside lower end of each of said walers.

5. The forming structure of claim 1 further characterized by each of the brackets having a pair of spaced confronting bracket flanges, one of the adjustable braces having its opposite brace ends each positioned between a pair of the bracket flanges, and pin means joining each of the brace ends with a pair of the bracket flanges.

6. The forming structure of claim 5 further characterized by said casters each being suspended from a caster mounting flange, the caster mounting flange being secured to said mounting bracket beneath said spaced confronting bracket flanges.

7. The forming structure of claim 1 further characterized by concrete forms mounted on the exterior of the forming structure, clamp structures extended about three sides of said waler assemblies, and each waler assembly including attachment clamp portions on opposite sides of each waler assemblies, and concrete form fasteners securing said concrete forms to said attachment clamp portions thereby attaching the concrete forms in assembly therewith.

8. The forming structure of claim 7 further characterized by the concrete forms having metal attachment angles mounted on a backside thereof, said concrete form fasteners being secured with said attachment angles on opposite sides of each waler assembly.

9. The forming structure of claim 1 further characterized by said mounting brackets each having a pair of horizontally extending vertically upright bracket flanges, one of said braces having its opposite ends extended between transversely spaced pairs of said upright bracket flanges, and fasteners securing said ends of braces in assembly with each of the associate pairs of upright bracket flanges.

10. The forming structure of claim 1 further characterized by a lower angle being superimposed on top of the mounting brackets along an inside surface of said waler assemblies but spaced inwardly from said waler assembly, and fasteners connecting each of a series of the mounting brackets to said lower angle thereby connecting waler assemblies through the mounting brackets in rigidified assembly together.

11. The forming structure of claim 10 further characterized by each of said mounting brackets having a bracket mounting plate welded to said mounting bracket and with said lower angle being secured by said fasteners to said mounting plate.

12. The forming structure of claim 1 further characterized by the mounting bracket having spaced upright flanges comprising strut mounting means extending inwardly of said jack and said caster for receipt of an end of the strut between said up right flanges for assembly therewith.

13. The forming structure of claim 1 further defined by a nut being attached to one of said spaced generally parallel flanges in alignment with said lower opening and with the threads on said shaft being in threaded retaining engagement with said nut to retain the jack in traveling assembly with the forming structure.

14. In a traveling culvert/tunnel forming structure including upright waler assemblies positioned in rows in transversely spaced relation on each side of said forming structure, the waler assemblies being adapted to receive forms on outside surfaces thereof, horizontally adjustable header assemblies supported at opposite ends by said spaced upright waler assemblies, collapsible braces secured between the upright waler assemblies enabling the upright waler assemblies to move towards and away from one another, the improvement of multi purpose mounting brackets mounted on said rows of said upright waler assemblies and extending inwardly from the waler assemblies the mounting brackets being arranged in rows, rows of casters swivelly mounted on said brackets inside of said rows of upright waler assemblies beneath said header assemblies, a pair of rows of traveling leveling jacks mounted on said brackets outside of said row of casters for elevating the forming structure and its casters out-of-contact with a ground supporting surface, the traveling leveling jacks each having an upstanding jack shaft, threads on said shaft in threaded retaining engagement with one of said brackets in traveling assembly therewith, said shafts being located between said upright waler assemblies and said casters, the leveling jacks being at all times carried on said brackets in assembly with the forming structure, and means on said jack enabling said jacks to be vertically adjustable for positioning the upright waler assemblies in predetermined adjusted above ground relation to one another, said mounting brackets each including a pair of upright bracket plates, a pair of vertically spaced generally parallel plate-like flanges at right angles to said upright bracket plates and secured therewith and with said flanges having vertically aligned upper and lower openings, each of said jacks being positioned beneath an associated pair of said flanges and with its jack shift projecting upwardly through said lower opening and having its upper jack shaft end positioned beneath said second opening for receipt of a wrench for adjustment of the jack position by rotation of said jack shaft, a pair of longitudinally extended reinforcing members disposed in transversely spaced relation interiorly of said forming structure with each reinforcing member being mounted on said row of brackets along the associated row of brackets, and means securing said reinforcing members to one of said plate-like flanges on said brackets in the associated rows.

* * * * *